US006354662B1

(12) United States Patent
Su

(10) Patent No.: US 6,354,662 B1
(45) Date of Patent: Mar. 12, 2002

(54) WAISTREST ASSEMBLY FOR A CHAIR

(76) Inventor: Tung-Hua Su, No. 16, Alley 23, Lane 900, Min Sheng St., Kuei Jen, Tainan Hsien (TW)

( * ) Notice: Subject to any disclaimer, the term of this patent is extended or adjusted under 35 U.S.C. 154(b) by 0 days.

(21) Appl. No.: 09/753,465

(22) Filed: Jan. 4, 2001

(51) Int. Cl.[7] ..... A47C 3/025
(52) U.S. Cl. ..... 297/284.7; 297/284.4
(58) Field of Search ..... 297/284.4, 284.7, 297/284.5

(56) References Cited

U.S. PATENT DOCUMENTS 5,505,520 A * 4/1996 Frusti et al. ..... 297/284.4
5,507,559 A * 4/1996 Lance ..... 297/284.5
6,059,362 A * 5/2000 Lin ..... 297/284.5
6,062,649 A * 5/2000 Nagel et al. ..... 297/452.38
6,260,921 B1 * 7/2001 Chu et al. ..... 297/284.4

* cited by examiner

*Primary Examiner*—Anthony D. Barfield
*Assistant Examiner*—Stephanie N. Harris
(74) *Attorney, Agent, or Firm*—Rosenberg, Klein & Lee

(57) ABSTRACT

A waistrest assembly comprises two adjusting seats securely attached to two lateral sides of a backrest, respectively, two connecting blocks, and a waistrest. Each adjusting seat includes a vertical guide slot. Each connecting block is snugly held in and slidable along an associated vertical guide slot. The waistrest comprises a support plate and a pad securely attached to a side of the support plate. The support plate includes a connecting portion in each of two ends thereof. A fastener is extended through an associated connecting block and an associated connecting portion to thereby secure the support plate and the connecting block together. The connecting blocks are movable in the vertical guide slots to thereby adjust a vertical position of the pad of the waistrest.

2 Claims, 5 Drawing Sheets

WAISTREST ASSEMBLY FOR A CHAIR

BACKGROUND OF THE INVENTION

1. Field of the Invention

The present invention relates to a waistrest assembly for a chair, and more particularly to a chair waistrest assembly that is adjustable in a level thereof according to need.

2. Description of the Related Art

Some of the chairs include a protrusion on a backrest thereof to support the waist of the user for relieving fatigue in the waist portion of the body. Nevertheless, position of the protrusion cannot be adjusted such that the level thereof cannot suit various users of different heights.

SUMMARY OF THE INVENTION

It is the primary object of the present invention to provide a chair waistrest assembly that is adjustable in a level thereof so as to suit various users of different heights.

A waistrest assembly in accordance with the present invention comprises two adjusting seats securely attached to two lateral sides of a backrest, respectively, two connecting blocks, and a waistrest. Each adjusting seat includes a vertical guide slot. Each connecting block is snugly held in and slidable along an associated vertical guide slot. The waistrest comprises a support plate and a pad securely attached to a side of the support plate. The support plate includes a connecting portion in each of two ends thereof. A fastener is extended through an associated connecting block and an associated connecting portion to thereby secure the support plate and the connecting block together. The connecting blocks are movable in the vertical guide slots to thereby adjust a vertical position of the pad of the waistrest.

Each adjusting seat includes a first bearing surface that faces away from the backrest. Each connecting portion of the waist includes a second bearing surface that bears against the first bearing surface of an associated adjusting seat. The waist is shiftable in response to a change in a sitting position of a user with the first bearing surfaces bearing against the second bearing surfaces, respectively.

The waist assembly in accordance with the present invention can be attached to the backrest easily and can be adjusted in the vertical position thereof to suit various users having different heights. In addition, the waistrest may shift and thus change the supporting direction in response to a change in the sitting position of the user. The bearing surfaces of the support plate of the waistrest bear against the bearing surfaces of the adjusting seats to prevent excessive shift of the waistrest and to increase the support reliability.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
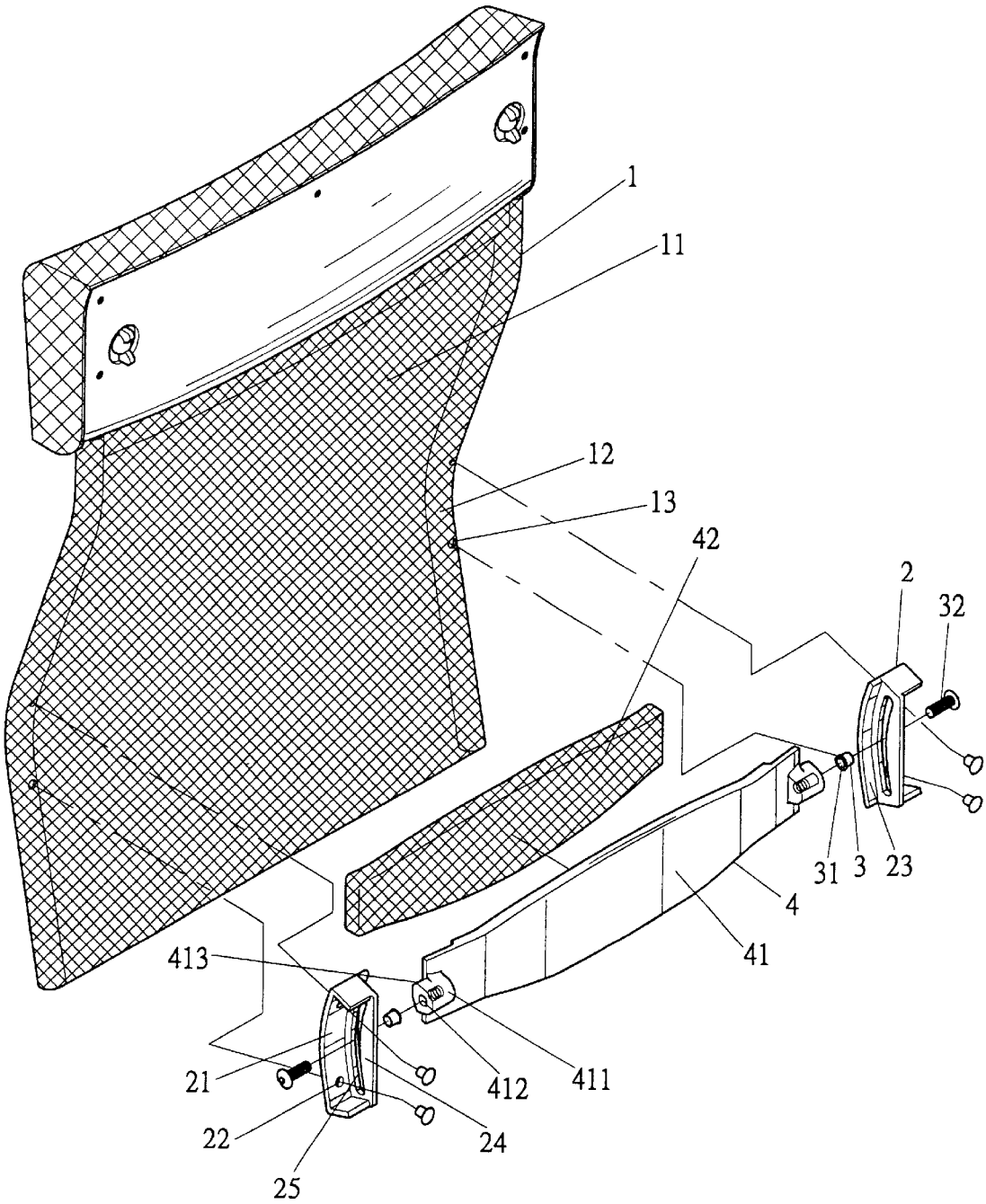
FIG. 1 is an exploded perspective view of a waistrest assembly in accordance with the present invention.
Figure 2:
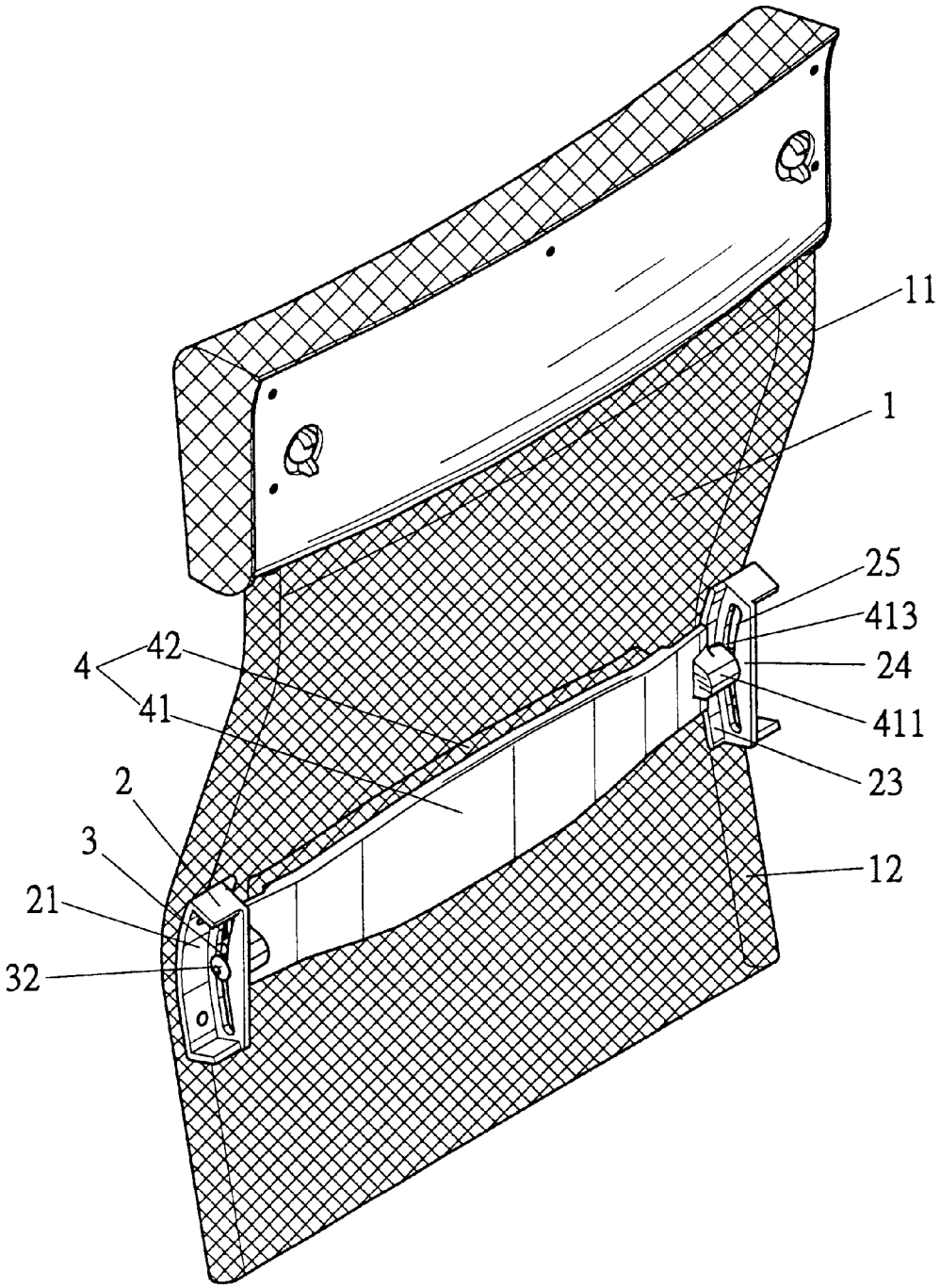
FIG. 2 is a perspective view of the waistrest assembly in accordance with the present invention.

Referring to FIGS. 1 and 2, a waistrest assembly for a chair in accordance with the present invention generally includes two adjusting seats 2, two connecting blocks 3, and a waistrest 4. A backrest 1 generally includes a pad 11 mounted to a center thereof and includes holes 13 in each of two lateral sides 12 thereof. Each adjusting seat 2 is substantially a plate 21 with holes 22 for engagement with an associated lateral side 12 of the backrest 1 by fasteners (not labeled). Each lateral side 12 may include a solid frame therein to provide a reliable support. The plate 21 includes a bearing surface 23 that faces away from the backrest 1. A guide plate 24 extends from each plate 21 and includes a guide slot 25 that extends substantially along a vertical direction. Each connecting block 3 is snugly mounted in an associated guide slot 25 and slidable along the guide slot 25.

The waistrest 4 includes a support plate 41 and a pad 42. The support plate 41 includes a connecting portion 411 on each of two ends thereof. Each connecting portion 411 includes a screw hole 412 for engaging with a fastener (such as a bolt 32) that extends through a hole 31 in an associated block 3. Each connecting portion 412 further includes a bearing surface 413 that bears against the bearing surface 23 of the associated plate 21. The pad 42 is securely attached to a side of the support plate 41 and in contact with a rear side of the pad 11.

Figure 3:
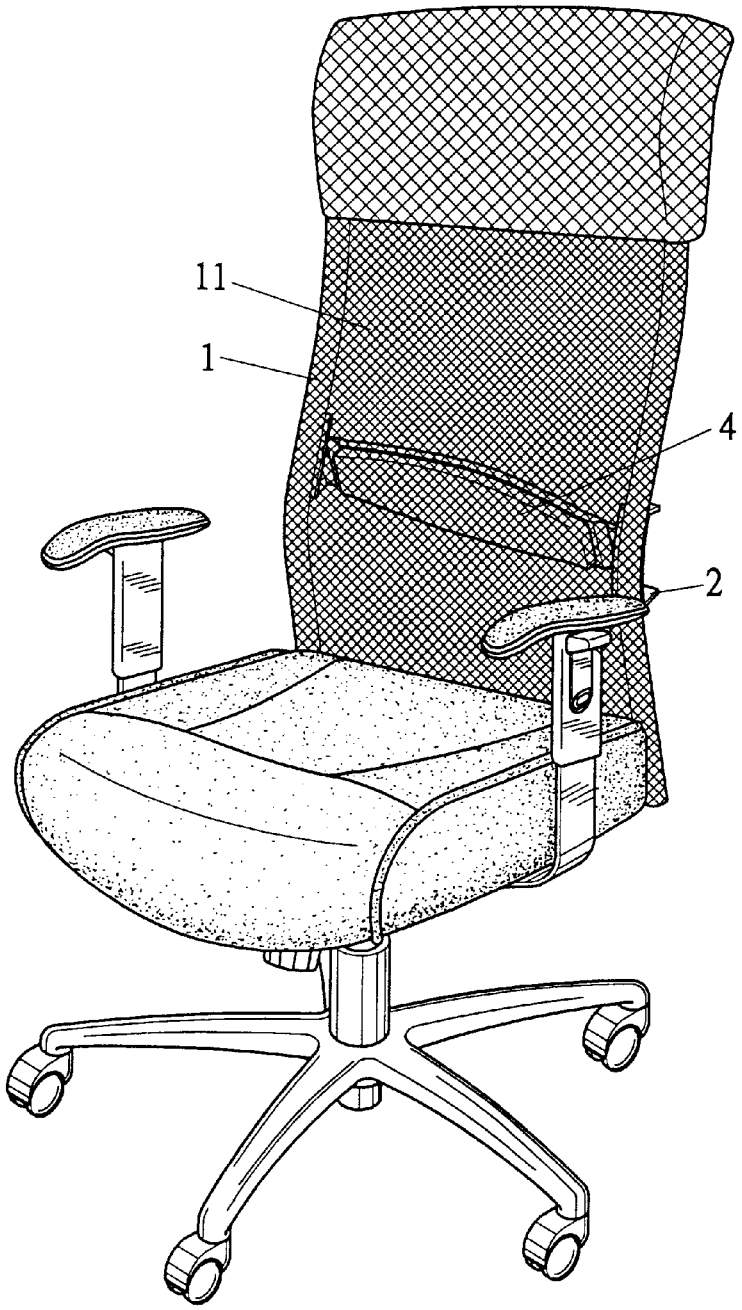
FIG. 3 is a perspective view of a chair equipped with the waistrest assembly in accordance with the present invention.

In assembly, as illustrated in FIGS. 2 and 3, the adjusting seats 21 are mounted to the lateral sides 12 of the backrest 1, respectively. In addition, bolts 32 are respectively extended through the holes 31 of the connecting blocks 3 and then engaged with the screw holes 412 of the connecting portions 411 of the support plate 41. The waistrest 4 is thus attached to the backrest 1.

Figure 4:
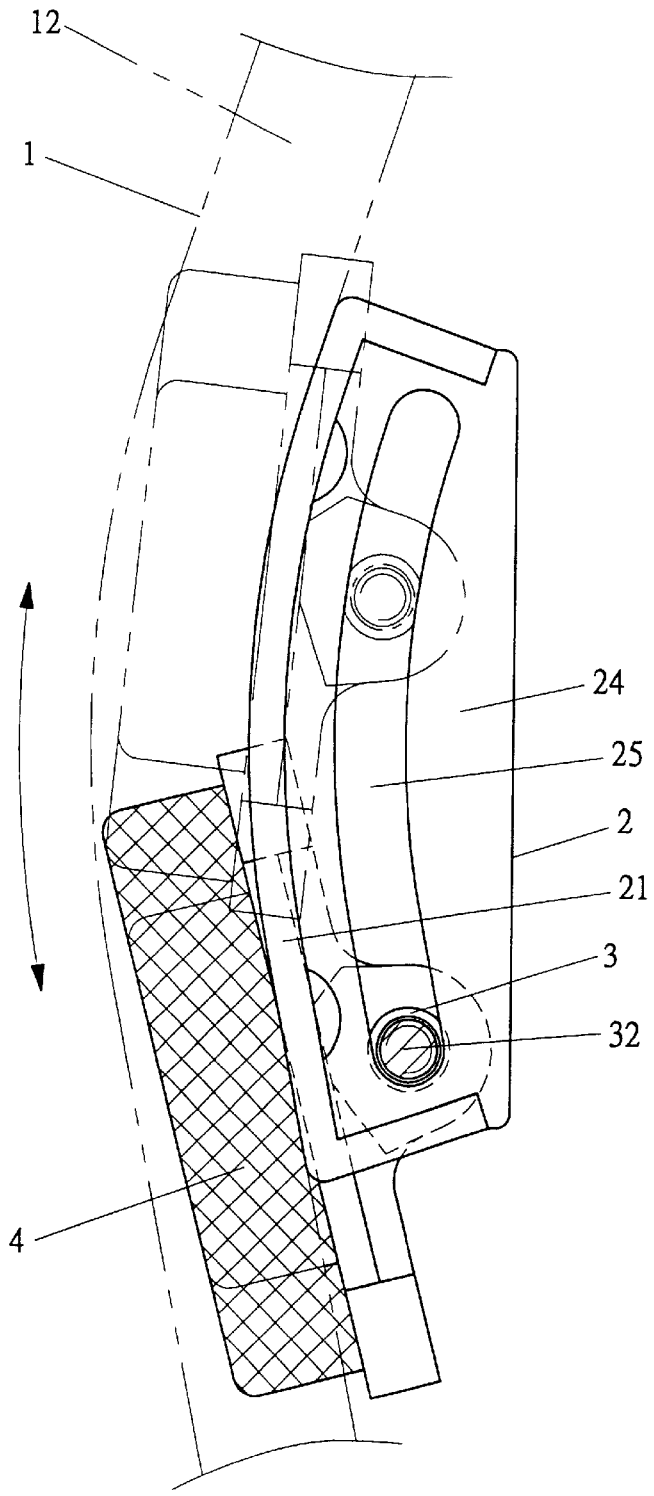
FIG. 4 is a sectional view illustrating adjustment of the waistrest assembly in accordance with the present invention.
Figure 5:
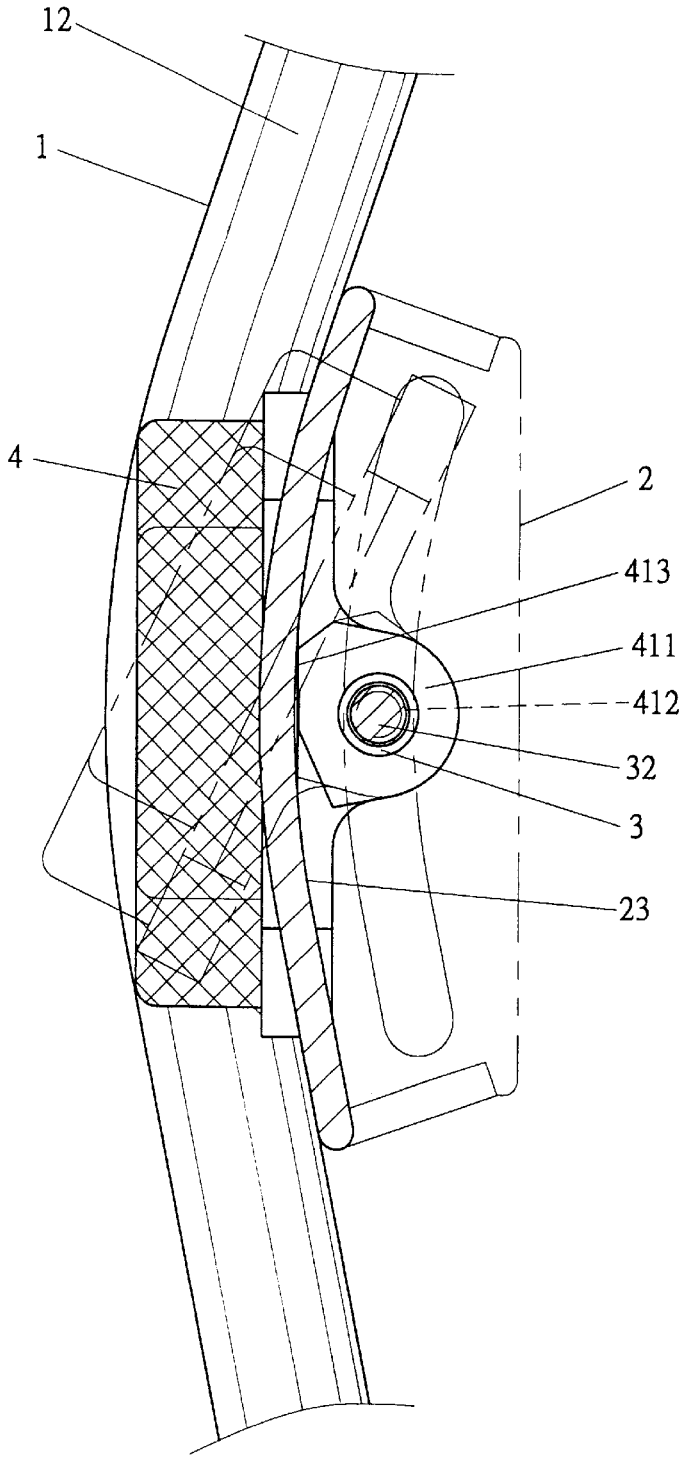
FIG. 5 is a sectional view similar to FIG. 4, illustrating use of the waistrest assembly.

As illustrated in FIG. 4, the user may force the connecting blocks 3 to slide in the guide slots 25 to thereby adjust the vertical position of the waistrest 4. As illustrated in FIG. 5, when in use, the waistrest 4 may shift in response to the lying direction of the user's waist, thereby providing a comfortable support. The bearing surfaces 413 of the support plate 41 of the waistrest 4 bear against the bearing surfaces 23 of the adjusting seats 2 to prevent excessive shift of the waistrest 4 and to increase the support reliability.

According to the above description, it is appreciated that the waistrest assembly in accordance with the present invention can be attached to the backrest 1 easily and can be adjusted in the vertical position thereof to suit various users having different heights. In addition, the waistrest 4 may shift and thus change the supporting direction in response to a change in the sitting position of the user. The bearing surfaces 413 of the support plate 41 of the waistrest 4 bear against the bearing surfaces 23 of the adjusting seats 2 to prevent excessive shift of the waistrest and to increase the support reliability.

Although the invention has been explained in relation to its preferred embodiment, it is to be understood that many other possible modifications and variations can be made without departing from the scope of the invention as hereinafter claimed.

What is claimed is:

1. A waistrest assembly adapted to be attached to a chair backrest, the waistrest assembly comprising:

two adjusting seats securely attached to two lateral sides of a backrest, respectively, each said adjusting seat including a vertical guide slot;

two connecting blocks snugly held in and slidable along the vertical guide slots, respectively; and a waistrest comprising a support plate and a pad securely attached to a side of the support plate, the support plate including a connecting portion in each of two ends thereof, a fastener being extended through an associated said connecting block and an associated said connecting portion to thereby secure the support plate and the connecting block together, wherein the connecting blocks are movable in the vertical guide slots to thereby adjust a vertical position of the pad of the waistrest.

2. The waistrest assembly as claimed in claim 1, wherein each said adjusting seat includes a first bearing surface that faces away from the backrest, each said connecting portion of the waist including a second bearing surface that bears against the first bearing surface of an associated said adjusting seat, the waist being shiftable in response to a change in a sitting position of a user with the first bearing surfaces bearing against the second bearing surfaces, respectively.

* * * * *